US008967892B2

(12) United States Patent
Ishii et al.

(10) Patent No.: US 8,967,892 B2
(45) Date of Patent: Mar. 3, 2015

(54) TAPE PRINTER WHICH PRINTS PURCHASE SUPPORT INFORMATION FOR A TAPE CARTRIDGE

(71) Applicant: Brother Kogyo Kabushiki Kaisha, Nagoya-shi, Aichi (JP)

(72) Inventors: Hidekazu Ishii, Nagoya (JP); Koichi Kondo, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 166 days.

(21) Appl. No.: 13/661,331

(22) Filed: Oct. 26, 2012

(65) Prior Publication Data

US 2013/0121743 A1 May 16, 2013

(30) Foreign Application Priority Data

Oct. 31, 2011 (JP) ..... 2011-239481

(51) Int. Cl.
*B41J 3/407* (2006.01)
*B41J 11/00* (2006.01)
*B41J 15/04* (2006.01)

(52) U.S. Cl.
CPC ..... *B41J 3/4075* (2013.01); *B41J 11/009* (2013.01); *B41J 15/044* (2013.01)
USPC ..... 400/613; 400/194; 400/196; 400/207; 347/214

(58) Field of Classification Search
CPC ..... B41J 3/4075; B41J 3/407; B41J 15/044; B41J 2/17543; B41J 32/00
USPC ..... 400/613, 194, 196, 207; 399/25, 24; 347/214
See application file for complete search history.

(56) References Cited

U.S. PATENT DOCUMENTS

| | | | | |
|---|---|---|---|---|
| 6,102,508 | A * | 8/2000 | Cowger | 347/7 |
| 6,585,433 | B2 * | 7/2003 | Davies et al. | 400/70 |
| 7,283,754 | B2 * | 10/2007 | Imes et al. | 399/8 |
| 2010/0272492 | A1 * | 10/2010 | Van Britsom et al. | 400/613 |

FOREIGN PATENT DOCUMENTS

| | | | |
|---|---|---|---|
| JP | 7227971 | A | 8/1995 |
| JP | 10309851 | A | 11/1998 |

OTHER PUBLICATIONS

Machine translation of JP Publ. No. 07-227971 to Hiwada published on Aug. 29, 1995.*
"Original & Compatible Ink & Toner Cartridge" published in 2007 by Brame.*

* cited by examiner

*Primary Examiner* — Blake A Tankersley
(74) *Attorney, Agent, or Firm* — McCarter & English, LLP

(57) ABSTRACT

The disclosure discloses a tape printer that includes a cartridge holder, a cartridge sensor, a feeding device, a printing device, a communication device, and a controller. The controller is configured to detect attribute information of a tape cartridge, identify a model of the mounted tape cartridge, and acquire corresponding current model information, acquire latest model information of the tape cartridge, from an information providing device related to the tape cartridge, generate purchase support information based on the acquired current model information and the acquired latest model information, when the tape cartridge of a model indicated by the current model information or the latest model information is newly purchased, and control the printing device so that the generated purchase support information is formed into print on a print-receiving tape.

10 Claims, 10 Drawing Sheets

TAPE PRINTER WHICH PRINTS PURCHASE SUPPORT INFORMATION FOR A TAPE CARTRIDGE

CROSS-REFERENCE TO RELATED APPLICATION

The present application claims priority from Japanese Patent Application No. 2011-239481, which was filed on Oct. 31, 2011, the disclosure of which is incorporated herein by reference in its entirety.

BACKGROUND

1. Field

The present disclosure relates to a tape printer that performs desired printing on a print-receiving tape.

2. Description of the Related Art

There are known printers configured to perform desired printing on a print-receiving medium, such as a print-receiving tape. In this printer, a cartridge filled with ink (an ink cartridge) is mounted, and the ink supplied from that mounted cartridge is used to perform printing on a print-receiving medium (recording medium).

Here, the ink within the cartridge is consumed with each use, and thus the cartridge is a consumable good. Accordingly, at the very least, when all of the ink within the cartridge is consumed, the operator must replenish the ink by purchasing a new cartridge in order to newly perform printing. Or, sometimes the operator purchases a new cartridge as a reserve before the ink within the cartridge is consumed as described above.

When purchasing a new cartridge as described above, the operator generally intends to purchase a cartridge of the same model as the cartridge being used at that point in time (that is, the cartridge mounted to the printer). Here, according to the prior art, once the time for cartridge replacement draws near, the model of the cartridge is printed on a recording medium, thereby producing a warning letter and notifying the operator accordingly.

Nevertheless, at the time the new cartridge is to be purchased, the possibility exists that the model of the cartridge that the operator intends to purchase has ceased to exist as the result of a model change, etc., on the manufacturer side due to changes in consumer needs, minor changes on the printer side, version upgrades, and the like. In such a case, the operator, for example, needs to investigate on his or her own the new model corresponding to the model of the cartridge that ceased to exist and write down and separately bring the investigation results to a distributor, etc., which is extremely troublesome.

On the other hand, known printers that perform printing on a print-receiving medium similar to the above prior art include tape printers that perform printing on a print-receiving tape. In the tape printer, when a tape cartridge is mounted to the cartridge holder, the print-receiving tape supplied from that mounted tape cartridge is fed, and desired printing is performed on that fed print-receiving tape by a printing device. Since the print-receiving tape is consumed with each use by printing, this tape cartridge is also a consumable good, similar to the above. Accordingly, in a case where the model of the tape cartridge that the operator intends to purchase has ceased to exist, the same troublesome task as previously described arises.

SUMMARY

It is therefore an object of the present disclosure to provide a tape printer capable of decreasing the trouble experienced by the operator at the time of tape cartridge purchase and improving user-friendliness, even in a case where the model of the tape cartridge that the operator wants to purchase has ceased to exist.

In order to achieve the above-described object, according to the aspect of the present application, there is provided a tape printer comprising: a cartridge holder configured to mount a tape cartridge configure to supply a print-receiving tape; a cartridge sensor configured to detect a portion to be detected, the portion formed on the tape cartridge; a feeding device configured to feed a print-receiving tape supplied from the tape cartridge mounted to the cartridge holder; a printing device configured to perform desired printing on the print-receiving tape fed by the feeding device, a communication device configured to perform network communication with a communication line; and a controller is configured to detect attribute information of the tape cartridge mounted to the cartridge holder via the cartridge sensor; identify a model of the mounted tape cartridge in accordance with the detected attribute information, and acquire corresponding current model information; acquire latest model information of the tape cartridge corresponding to the detected attribute information via the communication device, from an information providing device related to the tape cartridge; generate purchase support information based on the acquired current model information and the acquired latest model information, when the tape cartridge of a model indicated by the current model information or the latest model information is newly purchased; and control the printing device so that the generated purchase support information is formed into print on the print-receiving tape.

In the tape printer of the present disclosure, when the tape cartridge is mounted to the cartridge holder, the print-receiving tape supplied from that mounted tape cartridge is fed by a feeding device. Desired printing is then performed by the printing device on the fed print-receiving tape.

Since the print-receiving tape is consumed with each use by such printing formation, the tape cartridge is a consumable good. Accordingly, at the very least, when the print-receiving tape within the tape cartridge mounted to the cartridge holder is consumed and new print-receiving tape can no longer be fed, the operator must replenish the tape cartridge by purchasing a new tape cartridge in order to newly perform tape printing. Or, sometimes the operator purchases a new tape cartridge as a reserve before the print-receiving tape within the tape cartridge is consumed as described above.

At such a time of purchase of a new tape cartridge, the operator normally intends to purchase a tape cartridge of the same model as the tape cartridge used at that point in time (that is, the tape cartridge mounted to the cartridge holder). Nevertheless, at the time the new tape cartridge is purchased, the possibility exists that the model of the tape cartridge that the operator intends to purchase has ceased to exist as the result of a model change, etc., on the manufacturer side due to changes in consumer needs, minor changes on the tape printer side, version upgrades, and the like.

Here, in the present disclosure, the controller detects the attribute information (such as the tape width, tape color, and tape material, etc., of the print-receiving tape, for example) of the tape cartridge mounted to the tape cartridge holder, and acquires the current model information of the mounted tape cartridge corresponding to that attribute information. Further, the controller accesses a tape cartridge related information providing device (such as a product information site of the manufacturer of the tape printer, a distributer site, a mail-order site, etc., for example), and acquires the latest model information of the tape cartridge corresponding to the detected attributed information.

Then, based on both the current model information and the latest model information, the controller generates purchase support information. With this arrangement, in a case where the model of the tape cartridge that the operator intends to purchase has ceased to exist as described above, the new model information indicated by the latest model information newly prepared in place of the model that does not exist by the information providing device can be generated as the purchase support information, rather than the model indicated by the current model information, which does not exist. In a case where the model of the tape cartridge that the operator intends to purchase exists, the current model information corresponding to the current tape cartridge is simply generated as the purchase support information as is.

The purchase support information generated as described above is formed into print on the print-receiving tape by the printing device, based on the control of the controller. With this arrangement, the operator brings the tape cartridge removed from the cartridge holder after the purchase support information was formed into print on the print-receiving tape (or only the section of the print-receiving tape where print is formed, separated from the tape cartridge) to a distributor, etc., making it possible to reliably purchase a tape cartridge of the same function as the tape cartridge that the operator intended to purchase, even when the model has ceased to exist as described above. Accordingly, the operator, for example, no longer needs to investigate on his or her own the new model corresponding to the model of the tape cartridge that ceased to exist or write down and separately bring the investigation results to a distributor, etc. As a result, the trouble experienced by the operator when purchasing a new tape cartridge for replenishment or reserve is decreased, making it possible to improve user-friendliness.

DETAILED DESCRIPTION OF PREFERRED EMBODIMENTS

The following describes one embodiment of the present disclosure with reference to accompanying drawings.

System Configuration

Figure 1:
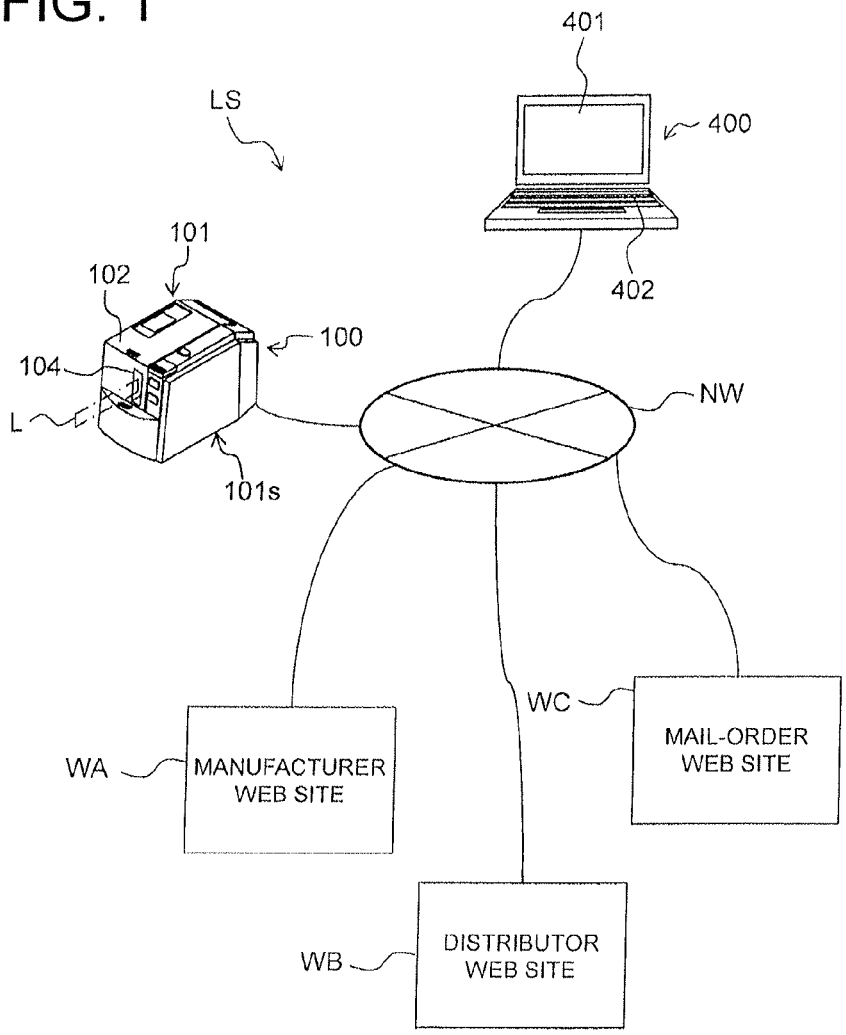
FIG. 1 is a system configuration diagram showing a label producing system comprising the label producing apparatus of an embodiment of the present disclosure.

The system configuration of the label producing system of this embodiment will now be described with reference to FIG. 1. In FIG. 1, a label producing system LS comprises a label producing apparatus 100 capable of producing a printed label L on which desired printing was performed, and an operation terminal 400 for operating the above described label producing apparatus 100. The label producing apparatus 100 and the operation terminal 400 are connected in an information communicable way via a wired or wireless communication line NW. Further, in this example, the label producing apparatus 100 and the operation terminal 400 are connected in an accessible manner to a product information Web site WA of a manufacturer of the label producing apparatus 100, a Web site WB of a distributor of the label producing apparatus 100, and a mail-order Web site WC of the label producing apparatus 100 via the above described communication line NW.

The label producing apparatus 100 has an apparatus main body 101 comprising an apparatus housing 101*s* of an overall right-angled parallelepiped shape, constituting an outer shell of the label producing apparatus 100. On the upper surface of the apparatus main body 101 is provided an opening/closing lid 102 provided in a manner that enables opening and closing (or in a detachable manner). A tape discharging exit 104 is provided on the front surface of the apparatus main body 101. This tape discharging exit 104 is a discharging exit for discharging a produced label tape 23 with print, etc. (refer to FIG. 3 and FIG. 4 described later).

The operation terminal 400 is generally a commercially-sold general purpose personal computer, which has a display portion 401, such as a liquid crystal display, and an operation portion 402, such as a keyboard or mouse. The operator can use the operation portion 402 to instruct production of the regular printed label L or a support information label LA described later.

Internal Configuration of Label Producing Apparatus

The outer appearance configuration of the cartridge holder and the cartridge in the interior of the label producing apparatus 100 will now be described with reference to FIG. 2. Note that, in FIG. 2, the illustration of the opening/closing lid 102 opened upward has been omitted to avoid illustration complexities.

Figure 2:
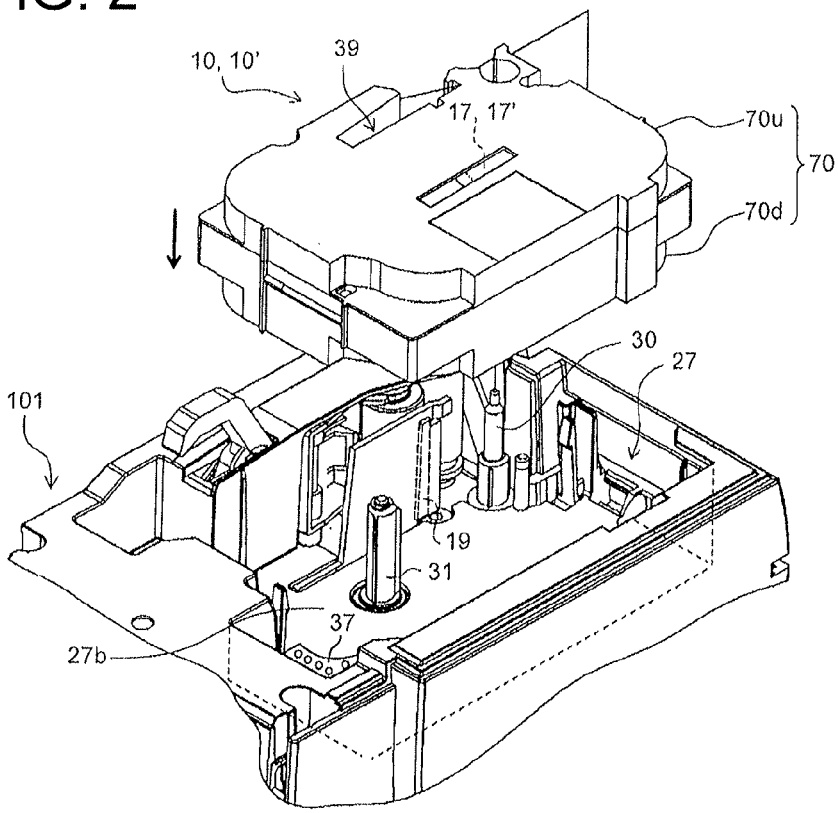
FIG. 2 is a perspective view showing the outer appearance configuration of a cartridge holder in the interior of the label producing apparatus main body and a cartridge mounted to the cartridge holder, with the opening/closing lid of the apparatus open.

In FIG. 2, a cartridge holder 27, a print head 19, a feeding roller driving shaft 30, a ribbon take-up roller driving shaft 31, and a cartridge sensor 37 are provided in the interior of the apparatus main body 101 of the label producing apparatus 100.

The cartridge holder 27 is capable of selectively attaching and detaching a plurality of types of cartridges 10 and 10', each having a different type of tape stored. The cartridge 10 is a cartridge (refer to FIG. 3 described later) having a base tape roll 17 around which is wound a base tape 16 for producing the printed label L. The cartridge 10' is a cartridge (refer to FIG. 4 described later) having a thermal tape roll 17' around which is wound a thermal tape 16' for producing the printed label L. Furthermore, the cartridge holder 27 is capable of selectively attaching and detaching a plurality of types of cartridges, each having a different tape width stored in each of the cartridges 10 and 10', each having a different type of the above described tape. Note that, hereinafter, the above described cartridges 10 and 10' are described as "the cartridge 10, etc." when generally termed.

The print head 19 performs desired printing on a cover film 11 described later (or the above described thermal tape 16') fed out from the above described feeding roller driving shaft 30, etc. The feeding roller driving shaft 30 and the ribbon take-up roller driving shaft 31 are driving shafts that respectively provide feeding driving power to a used ink ribbon 13 and the label tape 23 with print (for both, refer to FIG. 3 described later), and are rotationally driven in coordination.

The cartridge sensor 37 indirectly detects the type information (in other words, the attribute information described later) of the cartridge 10, etc., by mechanically detecting (or detecting in a non-contact manner) a portion 24 to be detected (refer to FIG. 3 to FIG. 4 described later) formed on the mounted cartridge 10, etc., when the cartridge 10, etc., is mounted. According to this embodiment, as previously described, the cartridge types available include a laminated type comprising the base tape 16 and the cover film 11 bonded thereto, such as the cartridge 10 shown in FIG. 3 described later, and a thermal type comprising the thermal tape 16', such as the cartridge 10' shown in FIG. 4 described later.

The cartridge 10, etc., comprises a cartridge housing 70 formed in a substantially overall right-angled parallelepiped shape, and a head insertion opening 39 that passes through both the front and rear surfaces for insertion of the above described print head 19 is formed on this cartridge housing 70.

Laminated-Type Cartridge

A case where the above described laminated-type cartridge 10 is mounted will now be described with reference to FIG. 3.

Figure 3:
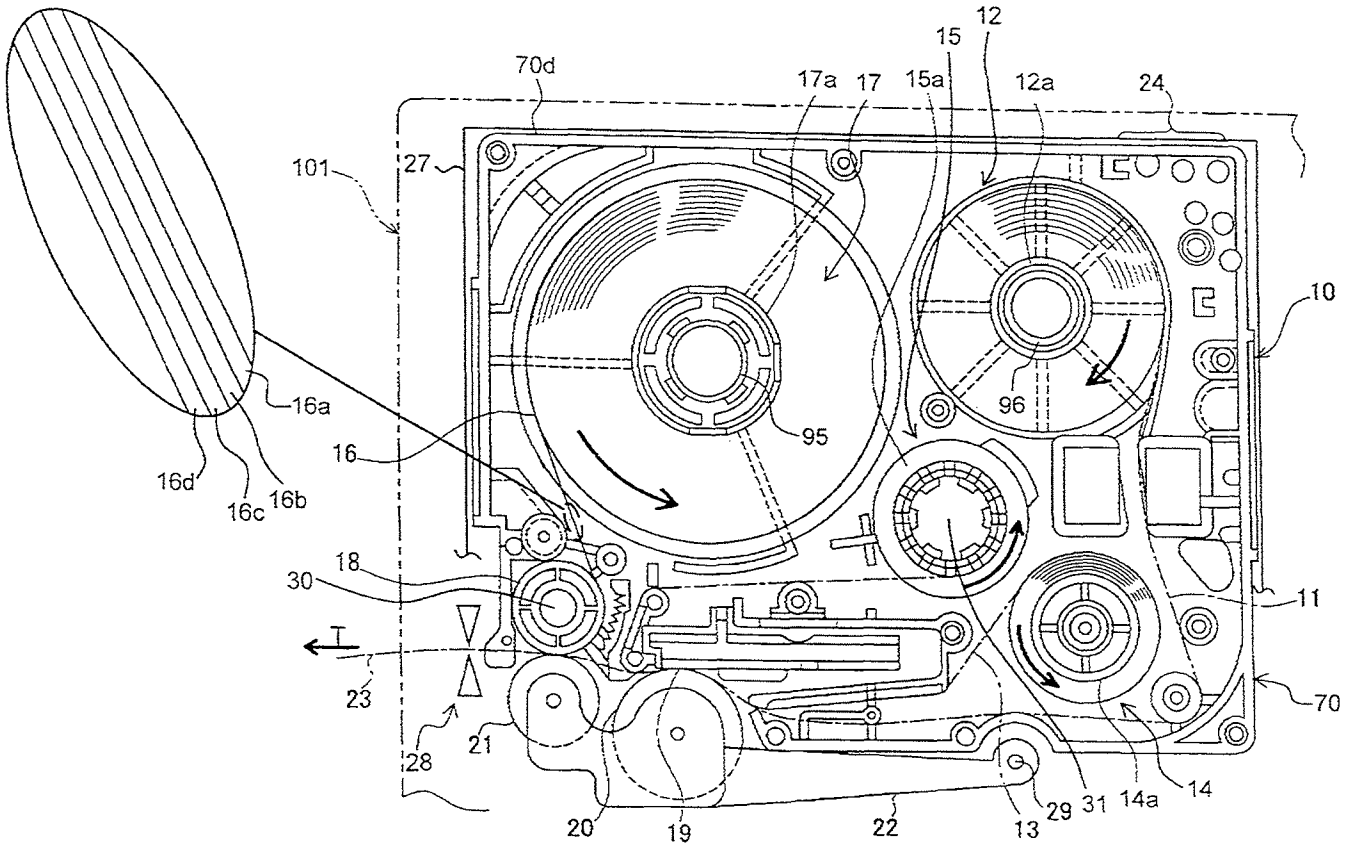
FIG. 3 is a diagram showing the area surrounding the cartridge holder with a laminated-type cartridge mounted thereto, along with the cartridge.

In FIG. 3, the cartridge 10 is detachably housed in the above described cartridge holder 27, which is a recess within the apparatus main body 101. The cartridge 10 comprises the base tape roll 17 around which the base tape 16 is wound, a cover film roll 12 around which the cover film 11 is wound, a ribbon supply side roll 14 configured to feed out the ink ribbon 13 for printing, a ribbon take-up roller 15 configured to wind up the ink ribbon 13 after printing, and a feeding roller 18.

The base tape roll 17 is provided with the above described base tape 16 that is wound around the periphery of a base tape spool 17*a* rotatably inserted into a boss 95 arranged in a standing condition on the bottom of the cartridge 10.

The base tape 16 comprises a layered structure of a plurality of layers (four layers in this example; refer to the partially enlarged view in FIG. 3). That is, the base tape 16 is designed with layers comprised of an adhesive layer 16*a* made of a suitable adhesive for bonding the above described cover film 11, a tape base layer 16*b* made of PET (polyethylene terephthalate) or the like, for example, an adhesive layer 16*c* made of a suitable adhesive, and a separation sheet 16*d*, which are layered in that order from the side rolled to the inside (the right side in the enlarged view) to the opposite side (the left side in the enlarged view).

The separation sheet 16*d* is peeled off when the above described printed label L eventually formed is to be affixed to an object such as a predetermined article, thereby making it possible to adhere the printed label L to the article or the like by the adhesive layer 16*c*.

The cover film roll 12 is provided with the cover film 11 that has substantially the same width as the above described base tape 16 in this example and is wound around the periphery of a cover film spool 12*a* rotatably inserted into a boss 96 arranged in a standing condition on the bottom of the cartridge 10.

The ink ribbon 13 is wound around the ribbon supply side roll 14, around a ribbon supply side spool 14*a*. The ribbon take-up roller 15 comprises a ribbon take-up spool 15*a*, and is driven by the above described ribbon take-up roller driving shaft 31 on the cartridge holder 27 side, thereby winding up the used ink ribbon 13 around the ribbon take-up spool 15*a*.

The feeding roller 18 is configured to affix the above described base tape 16 and the above described cover film 11 to each other by applying pressure, and feeds the label tape 23 with print thus formed in the direction of an arrow T in FIG. 3, when driven by the above described feeding roller driving shaft 30 on the cartridge holder 27 side. That is, the feeding roller 18 functions as a pressure roller as well.

The above described ribbon take-up roller 15 and the feeding roller 18 are rotationally driven in coordination by the driving power of a feeding motor 33 (refer to FIG. 5 described later), which is a pulse motor, for example, provided on the outside of each of the cartridges 10. This driving power is transmitted to the above described ribbon take-up roller driving shaft 31 and the feeding roller driving shaft 30 via a gear mechanism (not shown).

The portion 24 is formed on the cartridge 10 in the corner (the upper right corner in FIG. 3) that is opposite the above described feeding roller 18. A plurality of switch holes is formed in predetermined patterns on this portion 24, and each of these patterns includes cartridge attribute information as previously described, such as the type information of the cartridge 10, that is, the tape width, tape color, tape material, etc., of the base tape 16 and the cover film 11. The aforementioned cartridge sensor 37 (refer to FIG. 2) detects the pattern of the switch holes which differs according to the type of the cartridge 10 as described above, making it possible to detect the type of the cartridge 10.

On the other hand, the cartridge holder 27 comprises the above described print head 19, the above described ribbon take-up roller driving shaft 31, the above described feeding roller driving shaft 30, and a roller holder 22. The print head 19 comprises a great number of heat emitting elements, and performs printing in a predetermined print area of the cover film 11 fed out from the above described cover film roll 12.

The feeding roller driving shaft 30 feeds the cover film 11 fed out from the cover film roll 12 of the cartridge 10 mounted to the cartridge holder 27, and the base tape 16 fed out from the base tape roll 17 when driven by the above described feeding roller 18.

The roller holder 22 is rotatably supported by a support shaft 29 and can switch between a printing position and a release position via a switching mechanism (not shown). On this roller holder 22 are rotatably arranged a platen roller 20 and a tape pressure roller 21. When the roller holder 22 switches to the above described printing position (the position shown in FIG. 3), the platen roller 20 and the tape pressure roller 21 press against the above described print head 19 and the feeding roller 18.

Furthermore, on the cartridge holder 27 is arranged a cutter 28 that is adjacent to a discharging exit (not shown) of the cartridge 10. This cutter 28 operates when a cutter driving button 38 (refer to FIG. 5 described later) is pressed, cutting the label tape 23 with print at a desired length to generate the printed label L.

With the above described configuration, once the cartridge 10 is mounted to the above described cartridge holder 27, the ribbon take-up roller driving shaft 31 and the feeding roller driving shaft 30 are simultaneously rotationally driven by the driving power of the feeding motor 33 (refer to FIG. 5 described later). The feeding roller 18, the platen roller 20, and the tape pressure roller 21 rotate in accordance with the drive of the feeding roller driving shaft 30, thereby feeding out the base tape 16 from the base tape roll 17 and supplying the base tape 16 to the feeding roller 18 as described above. On the other hand, the cover film 11 is fed out from the cover film roll 12 and power is supplied to the plurality of heat emitting elements of the print head 19 by a print-head driving circuit 32 (refer to FIG. 5 described later). At this time, the ink ribbon 13 is pressed against the above described print head 19, coming in contact with the rear surface of the cover film 11. As a result, desired printing is performed in the predetermined print area on the rear surface of the cover film 11. Then, the above described base tape 16 and the above described cover film 11 on which printing was performed are affixed to each other by the feeding roller 18 and the tape pressure roller 21 so as to form a single tape, thereby forming the label tape 23 with print, which is then fed to outside the cartridge 10 via the above described discharging exit. The label tape 23 with print is then cut by the cutter 28 to generate the printed label L on which desired printing was performed.

Thermal-Type Cartridge

The structure of the area surrounding the cartridge holder 27 with the above described thermal-type cartridge 10' mounted thereto will now be described with reference to FIG. 4. Note that the components of FIG. 4 that are the same as those in the above described FIG. 3 are denoted using the same reference numerals and descriptions thereof will be omitted; only those components that differ from FIG. 3 will be described.

Figure 4:
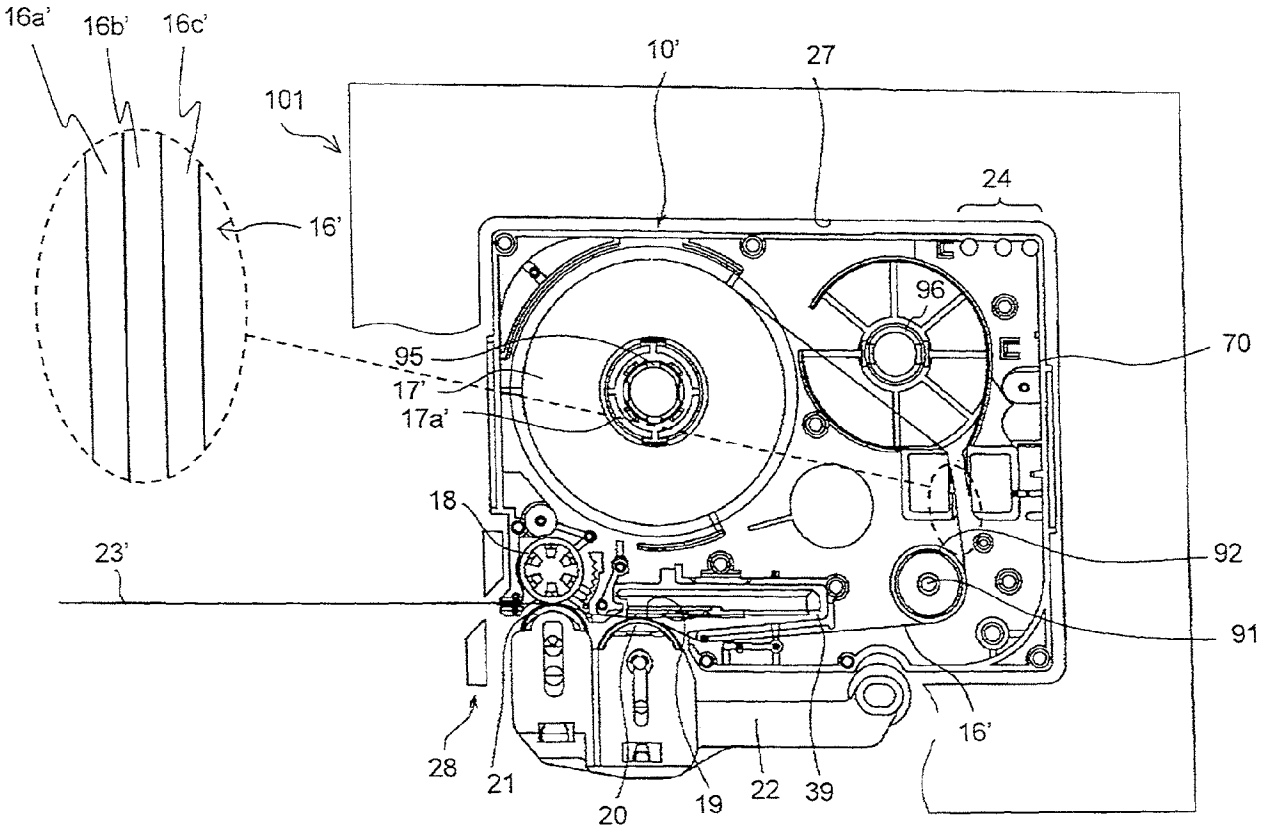
FIG. 4 is a diagram showing the area surrounding the cartridge holder with a thermal-type cartridge mounted thereto, along with the cartridge.

In FIG. 4, the cartridge 10' comprises the thermal tape roll 17' around which the thermal tape 16' is wound. This cartridge 10' differs from the above described laminated-type cartridge 10 in that it does not have the cover film roll 12 around which is wound the cover film 11, the ribbon supply side roll 14, or the ribbon take-up roller 15. The thermal tape roll 17' is provided with the above described thermal tape 16' that is wound around the periphery of a thermal tape spool **17*a*' rotatably inserted into the boss 95 arranged in a standing condition on the bottom of the cartridge 10'**.

The thermal tape 16', in this example, has a three-layered structure (refer to the partially enlarged view in FIG. 4), comprising a cover film **16*a*' made of PET (polyethylene terephthalate) or the like having a thermal recording layer on the surface, an adhesive layer 16*b*' made of a suitable adhesive material, and a separation sheet 16*c*'. The three layers of the thermal tape 16'** are layered in that order from the side rolled to the inside (the left side in the enlarged view) to the opposite side (the right side in the enlarged view).

When the cartridge 10' is mounted to the cartridge holder 27 and a roller holder 25 is moved to the contact position from a distant location, as previously described, the thermal tape 16' is brought between the print head 19 and the platen roller 20, and then between the feeding roller 18 and the tape pressure roller 21. Then, the feeding roller 18, the tape pressure roller 21, and the platen roller 20 are synchronously rotated so as to feed out the thermal tape 16' from the thermal tape roll 17'.

The fed thermal tape 16' is supplied to the print head 19 on the downstream side of the feeding direction from the above described head insertion opening 39 while guided to a substantially cylindrical shaped reel 92 rotatably inserted in a reel boss 91 arranged in a standing condition on the cartridge bottom. The print head 19 supplied with power as previously described prints print characters R on the surface of the above described cover film **16*a*' of the thermal tape 16', forming a label tape 23' with print, and feeds the label tape 23' with print to the outside of the cartridge 10'. Subsequently, the label tape 23' with print is cut by the cutter 28** to generate the printed label L on which desired printing was performed.

Note that, while in the cartridge 10' of the above described configuration printing is performed by only the heat emission of the print head 19 using the thermal tape 16' and not an ink ribbon, etc., in particular, the present disclosure is not limited thereto. That is, a tape comprising a transferred layer made of a transferred material capable of print formation by heat transfer from an ink ribbon may be used in place of the above described thermal tape 16', with printing performed using ink ribbon, similar to the cartridge 10 previously described.

Control System of the Label Producing Apparatus

The functional configuration of the control system of the label producing apparatus 100 will now be described with reference to FIG. 5.

Figure 8:
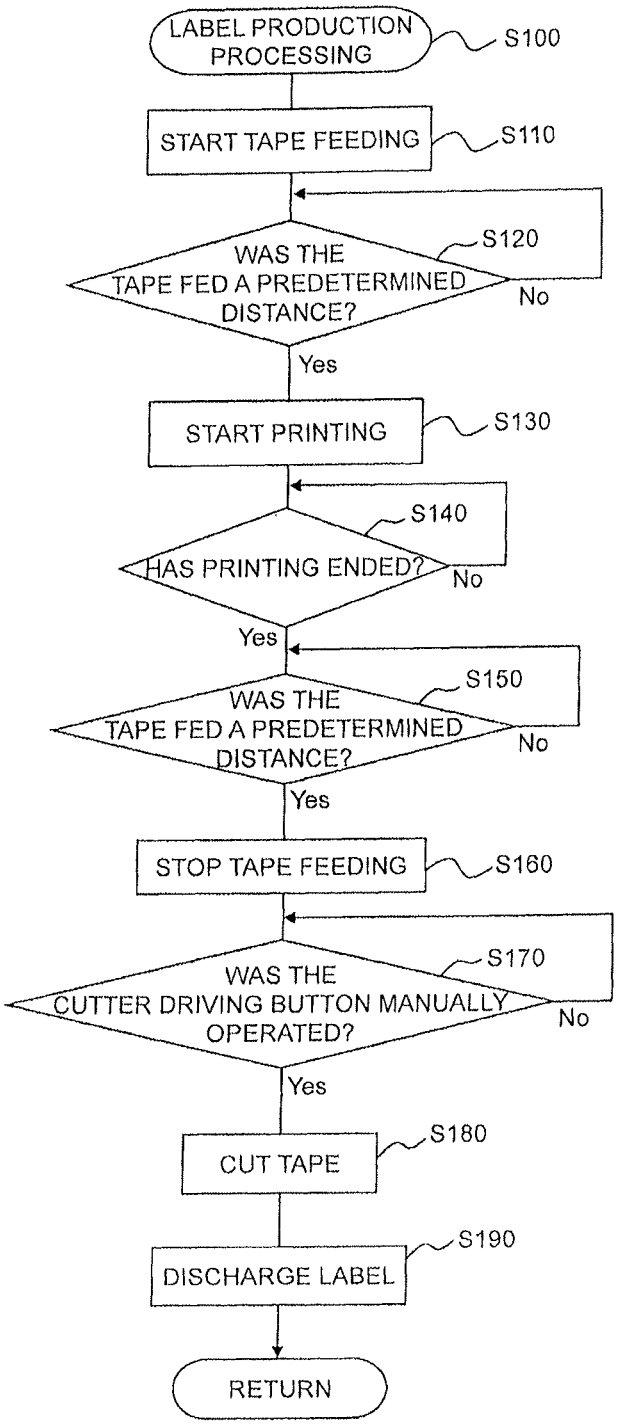
FIG. 8 is a flowchart showing the detailed procedure of step S100.

In FIG. 8, a control circuit 40 is disposed on a control board (not shown) of the label producing apparatus 100. The control circuit 40 is provided with a CPU 44, which is connected to an input/output interface 41, a ROM 46, a flash memory (EEPROM) 47, a RAM 48, a table storage portion 49, and a communication interface (communication I/F) 43, via a data bus 42.

The ROM 46 stores various programs required for control, such as a print-head driving control program configured to read the data of a print buffer 48B described later, drive the above described print head 19 and the feeding motor 33, and execute the procedures shown in the flows of FIGS. 7 to 10 described later, and a cutter driving control program configured to drive the feeding motor 33 so that the label tape 23 with print is fed to a cutting position after printing is completed, and drive a solenoid 35 described later to cut the label tape 23 with print. The CPU 44 performs various operations based on such programs stored in the ROM 46.

The RAM 48 temporarily stores the results of various operations performed by the CPU 44, and the like. This RAM 48 is provided with devices such as a text memory 48A, the print buffer 48B, and a work memory 48C that stores various operation data and the like. The text memory 48A stores print data such as document data.

The table storage portion 49 comprises in portion a storage area of the ROM 46 or the EEPROM 47, for example. This table storage portion 49 stores in advance a model table (not shown) that associates the forms of the portion 24 of the cartridges 10 and 10' with the models of the cartridges 10 and 10', set by the manufacturer of the label producing apparatus 100 when the label producing apparatus 100 is manufactured, for example.

The flash memory (EEPROM) 47 stores the current model information (details described later) of the cartridge 10, etc., each time a label is produced. The communication I/F 43 performs network communication with the operation terminal 400 via the above described communication line NW.

Further, the input/output interface 41 is connected to the print-head driving circuit 32 for driving the above described print head 19, a feeding motor driving circuit 34, a solenoid driving circuit 36, the above described cartridge sensor 37, and the cutter driving button 38.

The feeding motor driving circuit 34 drives the feeding motor 33, thereby driving the aforementioned feeding roller driving shaft 30 and ribbon take-up roller driving shaft 31, feeding the base tape 16, the cover film 11, and the label tape 23 with print. The solenoid driving circuit 36 drives the solenoid 35 for driving the above described cutter 28 to perform the cutting operation. The cutter driving button 38 is for activating the above described cutter 28 when manually operated by the operator to form the printed label L at a desired length.

The detection result of the portion 24 formed in the aforementioned cartridge 10, etc., is input from the cartridge sensor 37, and the CPU 44 detects the type information of the cartridge 10, etc., based on the detected result.

In the control system of the above described configuration, the print data produced by a suitable operation of the operation terminal 400 is input to the label producing apparatus 100 via the communication line NW. The input print data is sequentially stored in the text memory 48A. Then, the stored print data is read once again and subjected to predetermined conversion by a converting function of the control circuit 40, thereby generating dot pattern data. This data is then stored in the print buffer 48B. The print head 19 is driven via the print-head driving circuit 32 and each of the above described heat-emitting elements is selectively driven to emit heat in accordance with the print dots of one line, thereby printing the dot pattern data stored in the print buffer 48B. At the same time, the feeding motor 33 controls the feeding of the above described cover film 11, etc., via the feeding motor driving circuit 34, eventually producing the printed label L.

Outer Appearance of Printed Label

The outer appearance and structure of the printed label L produced by the label producing apparatus 100 as described above will now be described with reference to FIG. 6A.

Figure 6A:
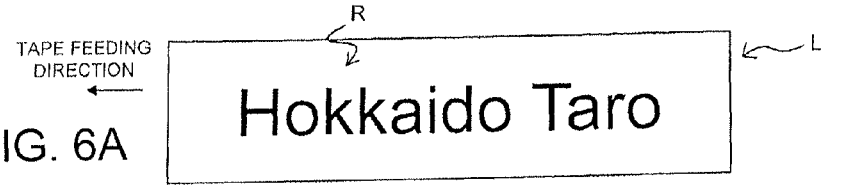
FIG. 6A is a top view showing an example of the outer appearance of a regular printed label produced by the label producing apparatus in an embodiment of the present disclosure, and a top view showing the outer appearance of a printed label on which purchase support information is formed into print in an embodiment of the present disclosure.

In FIG. 6A, the printed label L has a five layer structure with the cover film 11 added to the base tape 16 shown in the aforementioned FIG. 3. That is, the printed label L is designed with layers comprised of the cover film 11, the adhesive layer 16*a*, the tape base layer 16*b*, the adhesive layer 16*c*, and the separation sheet 16*d*, which are layered in that order from the front surface to the opposite side (cross-sectional structure not shown). On the rear surface of the cover film 11, the print characters R (the characters "Hokkaido Taro" in this example) of the content corresponding to the print data input via the operation portion 402 of the operation terminal 400 by the operator are printed by minor-image printing.

Special Characteristics of this Embodiment

In the basic configuration described above, the most significant special characteristic of this embodiment lies in that a support information label, on which purchase support information (details described later) which aids the operator when the operator newly purchases the cartridge 10, etc., is formed into print, is produced at suitable timing.

That is, as previously described, in the label producing apparatus 100, since the cover film 11, the base tape 16, the thermal tape 16', etc. (hereinafter simply referred to as "the print-receiving tapes 11, 16', etc.") of the cartridge 10, etc., are consumed with each use by print formation, the cartridge 10, etc., is a consumable good. Accordingly, at the very least, when the print-receiving tapes 11, 16', etc., of the cartridge 10, etc., mounted to the cartridge holder 27 are consumed and new print-receiving tapes 11, 16', etc., can no longer be fed, the operator must replenish the cartridge 10, etc., by purchasing the new cartridge 10, etc., in order to newly produce labels. Or, sometimes the operator purchases the new cartridge 10, etc., as a reserve before the print-receiving tape within the cartridge 10 is consumed as described above.

When purchasing such a new tape cartridge 10, etc., the operator generally intends to purchase the cartridge 10, etc., of the same model as the cartridge 10, etc., being used at that point in time (that is, the cartridge 10, etc., mounted to the cartridge holder 27). Nevertheless, at the time the above described new cartridge 10, etc., is to be purchased, the possibility exists that the model of the cartridge 10, etc., that the operator intends to purchase has ceased to exist as the result of a model change, etc., on the manufacturer side due to changes in consumer needs, minor changes on the label producing apparatus 100 side, version upgrades, and the like.

Figure 6B:
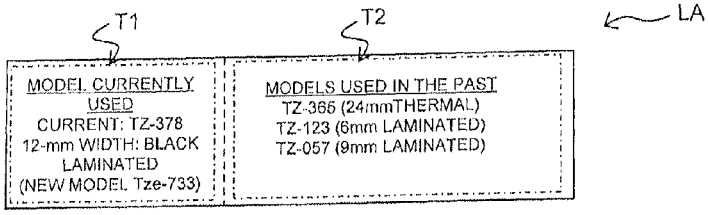
FIG. 6B is a top view showing another example of the outer appearance of a regular printed label produced by the label producing apparatus in an embodiment of the present disclosure, and a top view showing the outer appearance of a printed label on which purchase support information is formed into print in an embodiment of the present disclosure.

Here, in this embodiment, the support information label LA shown in FIG. 6B is produced at suitable timing based on an instruction from the operator as previously described. In FIG. 6B, the support information label LA comprises a current model and latest model information printing area T1 where the current model information and latest model information of the cartridge 10, etc., is formed into print as purchase support information, and a usage history information printing area T2 where the usage history information of the cartridge 10, etc., used in the past in the label producing apparatus 100 is formed into print as purchase support information. Note that, as shown, the usage history information printing area T2 is disposed further on the upstream side in the tape feeding direction than the current model information and latest model information printing area T1.

At this time, the above described current model information of the current model and latest model information printing area T1 is acquired as follows. That is, when the cartridge 10, etc., is mounted to the cartridge holder 27, the attribute information (such as the tape width, tape color, tape material, etc., of the print-receiving tape, for example) of the mounted cartridge 10, etc. is acquired by the CPU 44 based on the detection result of the cartridge sensor 37. Then, the CPU 44 acquires the model of the mounted cartridge 10, etc., as current model information by referring to the above described model table of the table storage portion 49 previously described in response to this acquired attribute information. In the example of FIG. 6B, the current model (expressed as "Model Currently Used" in the figure) is indicated as "TZ-378," the cover film 11 and the base tape 16 width are indicated as 12 mm, the color of the base tape 16 is indicated as black, and the above described cartridge 10 is indicated as a laminated type by print formation.

On the other hand, the above described latest model information is acquired as follows. That is, the CPU 44 accesses one of the product information Web site WA of the manufacture of the label producing apparatus 100, the Web site WB of the distributor, the mail-order Web site WC, etc., via the communication I/F 43. Then, the CPU 44 acquires the latest model information of the cartridge 10, etc., that corresponds to the attribute information acquired from the detection result of the cartridge sensor 37 as previously described. In the example of FIG. 6B, the latest model (expressed as "New model" in the figure) corresponding to the above described current model "TZ-378" is indicated as "Tze-733" by print formation.

Further, the above described usage history information of the usage history information printing area T2 is acquired as follows. That is, the label producing apparatus 100 can be used by suitably replacing a plurality of types of the cartridge 10, etc., as already described. Then, when the cartridge 10, etc., of the plurality of models is thus sequentially mounted to the cartridge holder 27 and used while being replaced, the control of the CPU 44 applies the model table as described above to the above described attribute information of each of the cartridges 10, etc., based on the cartridge sensor 37, and each time stores and accumulates the acquired model (that is, the current model information) of each of the cartridges 10, etc., as usage history information in the EEPROM 47. Then, when the above described support information label LA is produced, the usage history information is read from the EEPROM 47 and used. In the example of FIG. 6B, "Tz-356" (the thermal-type cartridge 10' having the thermal tape 16' with a 24-mm width), "Tz-123" (the laminated-type cartridge 10 having the cover film 11 with a 6-mm width), and "Tz-057" (the laminated-type cartridge 10 having the cover film 11 with a 9-mm width) are indicated as the models used in the past in the label producing apparatus 100 by print formation.

Note that the support information label LA of FIG. 6C and FIG. 6D will be described later (refer to modifications (1) and (2)).

Control Contents

The control contents executed by the CPU 44 of the control circuit 40 of the label producing apparatus 100 to achieve the above described contents will now be described with reference to FIG. 7.

Figure 7:
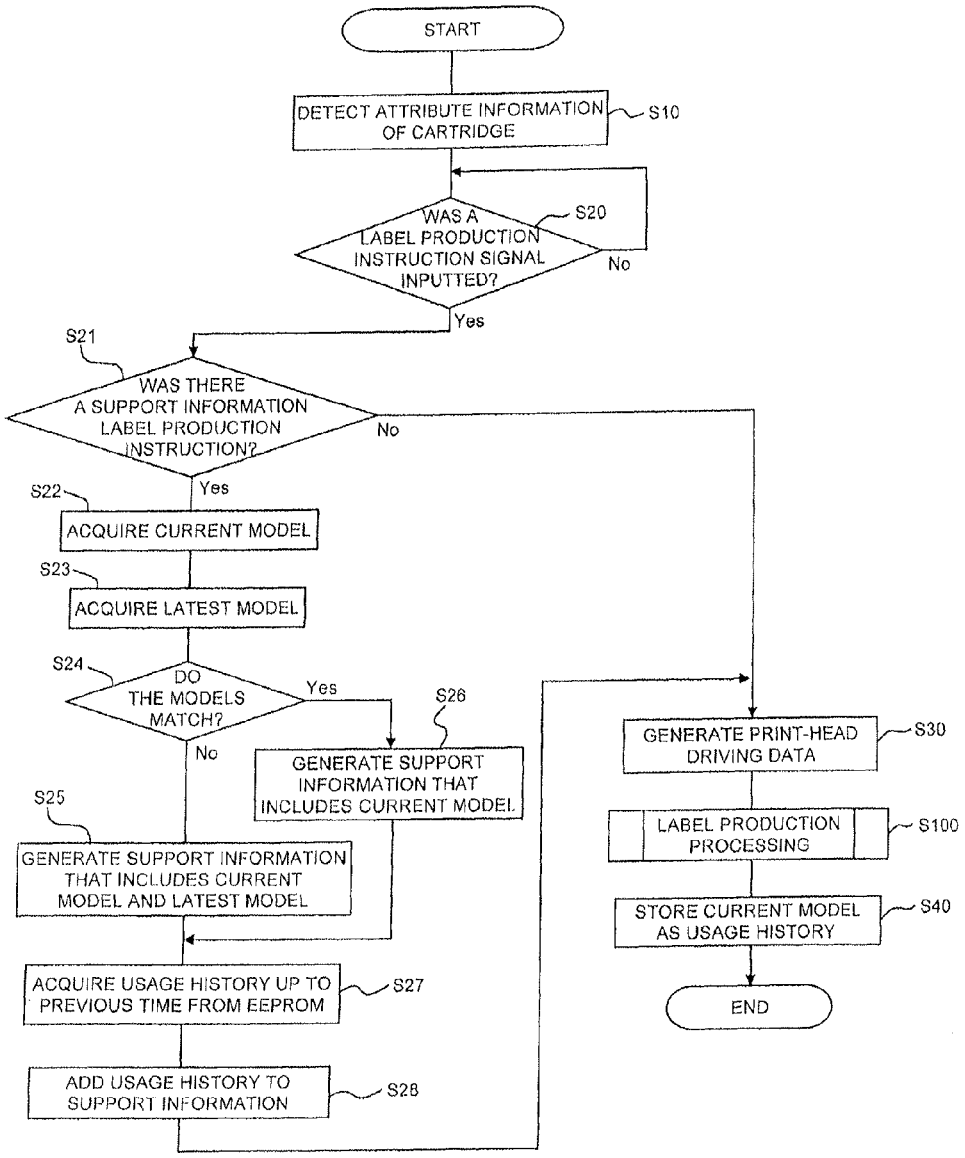
FIG. 7 is a flowchart showing the control contents executed by the CPU of the control circuit of the label producing apparatus.

In FIG. 7, the flow is started ("START" position) when the operator turns ON the power of the label producing apparatus 100, for example.

First, in step S10, the CPU 44 inputs a detection signal from the cartridge sensor 37 and, based on that input signal, detects the above described attribute information (in other words, the above described type information), such as the tape width, tape color, tape material, etc., of the base tape 16 and the cover film 11 of the cartridge 10, etc., mounted to the above described cartridge holder 27, and stores the detected information in the RAM 48, for example. Note that the CPU 44 may continually input the detection result of the cartridge sensor 37 and then store the result in the RAM 48 at this timing.

Subsequently, in step S20, the CPU 44 determines whether or not a label production instruction signal output from the operation terminal 400 has been input via the communication line NW. Here, as previously described, the existing labels produced by the label producing apparatus 100 include the regular printed label L on which the regular text of "Hokkaido Taro" indicated in FIG. 6A is formed into print, and the support information label LA on which the various support information previously described using FIG. 6B is formed into print. In a case where the operator intends to produce the printed label L, the print data for forming the above described text into print is generated according to a suitable operation performed by the operator using the operation portion 402, and the label production instruction signal of the regular printed label L that includes this print data is sent from the operation terminal 400. On the other hand, in a case where the operator intends to produce the support information label LA, the operator, for example, operates a function key and print key of the operation portion 402 in combination, thereby sending the label production instruction signal of the support information label LA from the operation terminal 400. Until one of the above described two label production instruction signals is input from the operation terminal 400, the decision is made that the condition is not satisfied (S20: No), and the CPU 44 enters a wait loop. If the label production instruction signal was input from the operation terminal 400, the decision is made that the condition is satisfied (S20: Yes), and the flow proceeds to step S21.

In step S21, the CPU 44 determines whether or not the label production instruction signal input from the operation terminal 400 in step S20 was a label production instruction signal of the support information label LA. In a case where the signal was the label production instruction signal of the support information label LA, the decision is made that the condition is satisfied (S21: Yes), and the flow proceeds to step S22. In a case where the signal input was the label production instruction signal of the regular label L and not the support information label LA, the decision is made that the condition is not satisfied (S21: No), the CPU 44 stores the print data included in the label production instruction signal in the text memory 48A, and the flow proceeds to step S30 described later.

In step S22, the CPU 44 acquires the current model information of the currently mounted cartridge 10, etc., corresponding to the attribute information of the cartridge 10, etc., acquired in the above described step S10 using the above described model table of the table storage portion 49.

Then, the flow proceeds to step S23 where the CPU 44 accesses the above described product information Web site WA, Web site WB of the distributor, mail-order Web site WC, etc., via the communication I/F 43, acquires the latest model information of the cartridge 10, etc., corresponding to the attribute information of the cartridge 10, etc., detected in the above described step S10, and stores that information in the EEPROM.

Subsequently, the flow proceeds to step S24 where the CPU 44 determines whether or not the latest model information acquired in step S23 and the current model information acquired in step S22 match content-wise. In a case where the latest model information and the current model information match, the decision is made that the condition of step S24 is satisfied (S24: Yes), and the flow proceeds to step S26. In a case where the latest model information and the current model information do not match sufficiently, the decision is made that the condition of step S24 is not satisfied (S24: No), and the flow proceeds to step S25.

In step S25, the CPU 44 generates the purchase support information, which includes both the latest model information ("Tze-733" in the example of FIG. 6B) acquired in step S23 and the current model information ("Tz-378" in the example of FIG. 6B) acquired in step S22. Subsequently, the flow proceeds to step S27.

On the other hand, in step S26, the CPU 44 generates the purchase support information, which includes the current model information ("Tz-378" in the example of FIG. 6B) acquired in step S22. Subsequently, the flow proceeds to step S27.

In step S27, the CPU 44 acquires the usage history information of the cartridge 10, etc., used in the label producing apparatus 100 up to that point in time, in the label producing apparatus 100 from the EEPROM 47. Note that the usage history information that is older than a predetermined elapsed time period, for example, may be cut and not acquired.

Subsequently, in step S28, the CPU 44 adds the above described usage history information ("Tz-356," which is the thermal-type cartridge 10' having the thermal tape 16' of a 24-mm width, "Tz-123," which is the laminated-type cartridge 10 having the color film 11 of a 6-mm width, and "Tz-057," which is the laminated-type cartridge 10 having the color film 11 of a 9-mm width, in the example of FIG. 6B) acquired in step S27 to the above described purchase support information generated in step S25 or step S26. Subsequently, the flow proceeds to step S30.

In step S30, the CPU 44 performs a predetermined conversion, for example, on the above described print data stored in the text memory 48A for producing the printed label L or on the purchase support information generated in the above described steps S25, S26, and S28 for producing the support information label LA, generating dot pattern data (print-head driving data) corresponding to the print contents of the print-receiving tapes 11, 16', etc. Then, the dot pattern data is stored in the print buffer 48B.

Subsequently, in step S100, the CPU 44 executes label production processing that produces the printed label L or the support information label LA on which the print corresponding to the above described dot pattern data is formed. That is, a plurality of heat emitting elements of the print head 19 is supplied with power by the above described print-head driving circuit 32 (refer to FIG. 5), thereby printing print on the print-receiving tapes 11, 16, etc., and forming the label tapes 23 and 23' with print.

Subsequently, in step S40, the CPU 44 stores the current model (the model acquired in step S22) used by the label production processing of the above described step S100 in the EEPROM 47 as usage history. Note that, in a case where the decision is made that the condition of step S21 is not satisfied and the label production processing of step S100 is performed via step S30, the CPU 44 may acquire the current model information and store that information as usage history in the EEPROM 47 in this step S40, in the same manner as the above described step S22.

The detailed procedure of step S100 of the above described FIG. 7 will now be described with reference to FIG. 8. Note that this FIG. 8 describes a case where a label is produced using the laminated-type cartridge 10 as an example.

First, in step S110, the CPU 44 outputs a control signal to the feeding motor driving circuit 34, and the feeding motor 33 drives the feeding roller driving shaft 30 and the ribbon take-up roller driving shaft 31. As a result, the feed-out of the base tape 16 from the base tape roll 17 and the feed-out of the cover film 11 from the cover film roll 12 are started, and the feeding of the base tape 16, the cover film 11, and the label tape 23 with print (hereinafter collectively simply referred to as "base tape 16, etc.") is started.

Subsequently, in step S120, the CPU 44 determines whether or not the base tape 16, etc., has been fed a predetermined distance. This predetermined distance is a feeding distance required for the top edge of the print area of the cover film 11 to arrive at a position substantially opposite the print head 19, for example. This determination of the feeding distance may be simply made by a known technique, such as by detecting a marking provided on the base tape 16 using a known tape sensor (not shown), or counting the number of pulses of a control pulse of a control signal output from the feeding motor driving circuit 34 to the feeding motor 33, which is a pulse motor, for example. Until the base tape 16, etc., is fed the predetermined distance, the decision is made that the condition of step S120 is not satisfied (S120: No), and the CPU 44 enters a wait loop; once the base tape 16, etc., is fed the predetermined distance, the decision is made that the condition of step S120 is satisfied (S120: Yes), and the flow proceeds to step S130.

In step S130, the CPU 44 outputs a control signal to the print-head driving circuit 32, causing the print head 19 to start printing in accordance with the above described print-head driving data in the print area of the cover film 11.

Subsequently, in step S140, the CPU 44 determines whether or not all of the printing in the above described print area of the cover film 11 has been completed (in other words, whether or not formation of all of the above described print-head driving data into print has been completed on the cover film 11 by the print head 19). Until all of the printing is completed, the decision is made that the condition is not satisfied (S140: No) and the CPU 44 enters a wait loop. Then, once all of the printing is completed, the decision is made that the condition is satisfied (S140: Yes) and the flow proceeds to step S150.

In step S150, the CPU 44 determines whether or not the base tape 16, etc., has been further fed a predetermined distance. This predetermined distance refers to a feeding distance that causes the entire print area to pass the cutter 28 by a predetermined length, for example. At this time, this feeding distance may be simply determined in the same manner as in the above described step S120, for example. Until the base tape 16, etc., is fed the predetermined distance, the decision is made that the condition is not satisfied (S150: No) and the CPU 44 enters a wait loop. Then, once the base tape 16, etc., is fed the predetermined distance, the decision is made that the condition is satisfied (S150: Yes) and the flow proceeds to step S160.

In step S160, the CPU 44 outputs a control signal to the feeding motor driving circuit 34, and stops the driving of the feeding roller driving shaft 30 and the ribbon take-up roller driving shaft 31 by the feeding motor 33, thereby stopping the feed-out of the base tape 16 and the cover film 11 from the base tape roll 17 and the cover film roll 12 as well as the feeding of the base tape 16, etc.

Subsequently, in step S170, the CPU 44 determines whether or not the above described cutter driving button 38 was manually operated by the operator. Until the cutter driving button 38 is manually operated, the decision is made that the condition is not satisfied (S: No), and the CPU 44 loops and waits. If the cutter driving button 38 has been manually operated, the decision is made that the condition is satisfied (S: Yes) and the flow proceeds to step S180.

In step S180, the CPU 44 outputs a control signal to the solenoid driving circuit 36 to drive the solenoid 35, causing the label tape 23 with print to be cut by the cutter 28. At this point in time, as previously described, the entire label tape 23 with print, including the above described print area, has sufficiently passed the cutter 28, and the cutting of this cutter 28 generates the printed label L or the support information label LA on which printing in accordance with the print-head driving data was performed.

Subsequently, in step S190, the CPU 44 outputs a control signal to a discharging motor (not shown) configured to drive a discharging roller (not shown) separately provided, and the printed label L or the support information label LA generated in the above described step S180 is discharged to outside of the apparatus. Note that in a case where the printed label L or the support information label LA can be manually discharged to outside of the apparatus without a discharging motor, this step S190 may be omitted. This routine then terminates here.

As described above, according to this embodiment, purchase support information is generated based on both the above described current model information and the latest model information based on the attribute information acquired by the cartridge sensor 37, producing the support information label LA on which the purchase support information is formed into print. With this arrangement, in a case where the model of the cartridge 10, etc., that the operator intends to purchase has ceased to exist, it is possible to produce the support information label LA with the new model information formed into print indicating the above described latest model information newly prepared on the manufacturer side in place of the model that does not exist as the purchase support information rather than the model indicated by the current model information, which does not exist. Note that, in a case where the model of the cartridge 10, etc., that the operator intends to purchase exists, the support information label LA with the current model information corresponding to the current cartridge 10, etc., formed as is into print as the purchase support information is produced. With this arrangement, the operator can reliably purchase the cartridge 10, etc., having the same function as the cartridge 10, etc., that the operator intended to purchase, even when the model has ceased to exist as described above, by bringing only the support information label LA separated from the tape cartridge 10, etc., (in other words, the section of the label tape 23 with print on which the purchase support information is formed into print) to a distributor, etc., or by bringing the cartridge 10, etc., removed from the cartridge holder 27 with the purchase support information formed into print on the label tape 23 with print to a distributor, etc., in a case where cutting is not performed. As a result, the operator, for example, no longer needs to investigate on his or her own the new model corresponding to the model of the cartridge 10, etc., that ceased to exist or write down and separately bring the investigation results to a distributor, etc. As a result, the trouble experienced by the operator when purchasing the new cartridge 10, etc., for replenishment or reserve is decreased, making it possible to improve user-friendliness.

Further, in particular, according to this embodiment, both the current model information and the latest model information are formed into print in the current model and latest model information printing area T1 of the support information label LA. With this arrangement, when the model ceases to exist as described above, the operator can clearly visually verify both the model of the cartridge 10, etc., that ceased to exist and that he or she intended to purchase and the model of the new cartridge 10, etc., corresponding to that model, by the print formed on the print-receiving tape. Accordingly, the sense of security of the operator when purchasing the new cartridge 10, etc., increases, making it possible to reliably improve user-friendliness.

Further, in particular, according to this embodiment, the usage history information is formed into print in the usage history information printing area T2 of the support information label LA. With this arrangement, the operator can clearly visually verify the models of the cartridge 10, etc., used in the label producing apparatus 100 in the past as well by the printed contents. As a result, the operator can accurately recognize the models of the cartridge 10, etc., with proven usage results in the label producing apparatus 100. Accordingly, the repeat reproducibility achieved when the operator uses the cartridge 10, etc., and performs tape printing using the label producing apparatus 100 can be increased.

Note that the present disclosure is not limited to the above described embodiment, and various modifications may be made without deviating from the spirit and scope of the disclosure. The following describes such modifications one by one. Note that components identical to those in the above embodiment are denoted using the same reference numerals, and descriptions thereof will be simplified or omitted as appropriate.

Figure 6C:
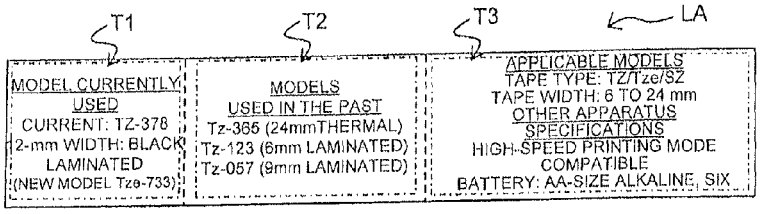
FIG. 6C is a top view showing another example of the outer appearance of a regular printed label produced by the label producing apparatus in an embodiment of the present disclosure, and a top view showing the outer appearance of a printed label on which purchase support information is formed into print in an embodiment of the present disclosure.

(1) When all Model Information and Apparatus Specification Information Applicable to the Label Producing Apparatus are Formed into Print FIG. 6C shows an example of the support information label LA of this modification. In addition to the above described current model and latest model information printing area T1 and usage history information printing area T2, this support information label LA comprises a printing area T3 for all model information, etc., in which all model information of the cartridge 10, etc., applicable to the label producing apparatus 100 as well as other apparatus specification information (performance information, specification information, etc.) of the label producing apparatus 100 are formed into print as purchase support information. Note that, as shown, the printing area T3 for all model information, etc., is disposed further on the upstream side in the tape feeding direction than the usage history information printing area T2.

The above described printing area T3 for all model information, etc., and the apparatus specification information are simply acquired from the storage contents of the EEPROM 47, etc., or from each of the Web sites WA to WC, as previously described. In the example of FIG. 6C, all models applicable to the label producing apparatus 100 are indicated by print formation as those models of the series "TZ-XXX," "Tze-XXX," and "SZ-XXX" having the print-receiving tapes 11, 16', etc., of 6-mm to 24-mm widths. Note that, in this example, the information corresponding to all model information (omitted information in this example) is expressed as "TZ/Tze/Sz" in the figure and not as the model information in its entirety (a full model description) per se. Further, compatibility with a predetermined high-speed printing mode and the need for six AA-size alkaline batteries when used based on battery power are indicated by print formation as the previously described apparatus specifications of the label producing apparatus 100.

Figure 9:
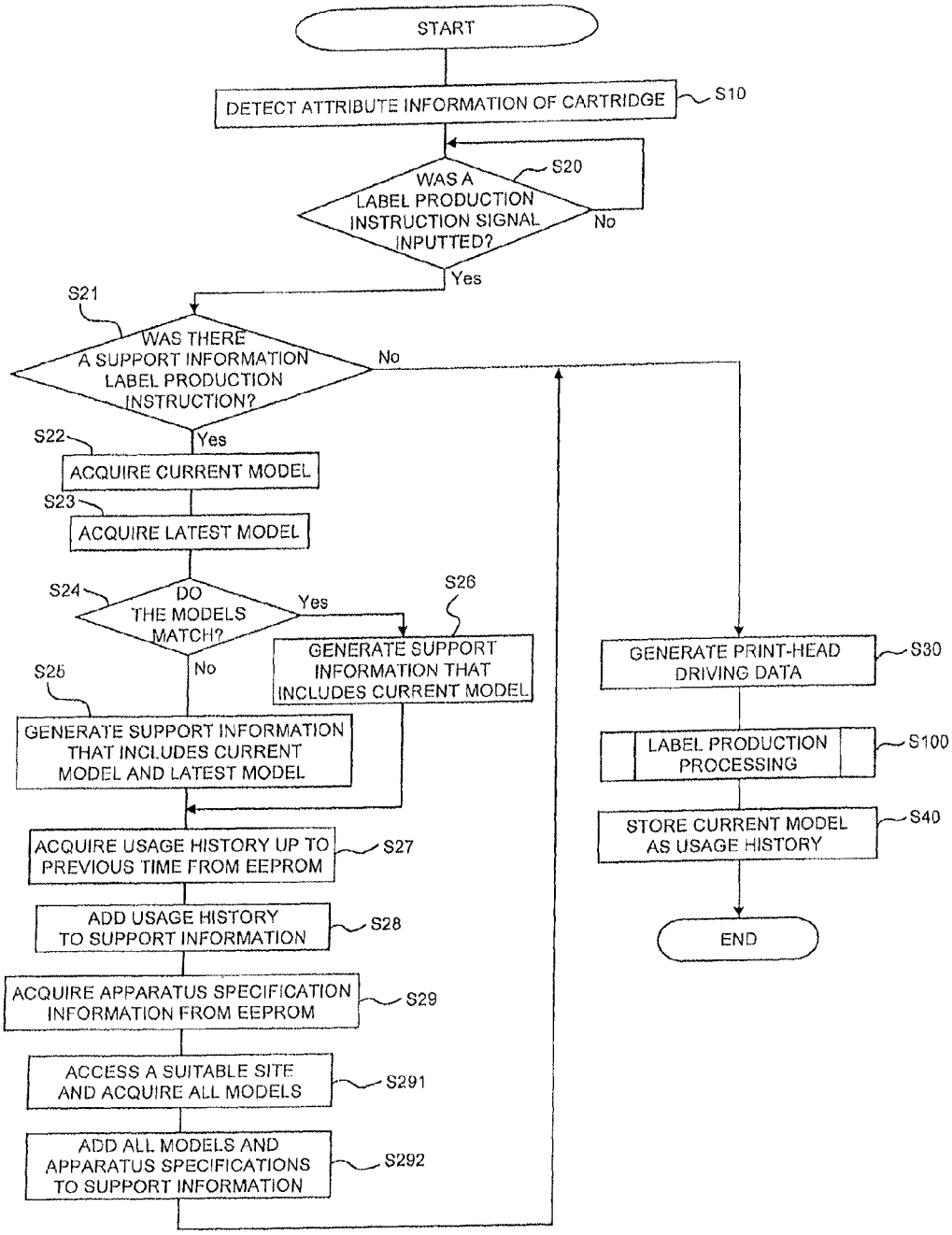
FIG. 9 is a flowchart showing the control contents executed by the CPU in a modification where all model information and apparatus specification information applicable to the label producing apparatus are formed into print.

FIG. 9 shows the control contents executed by the CPU 44 in this modification. Note that, in the flow shown in FIG. 9, the only differences from FIG. 7 are that steps S29, S291, and S292 are newly provided between step S28 and step S30 shown in FIG. 7.

That is, after the steps S10 to S28 of the above described FIG. 7 are performed, the CPU 44 acquires all model information and the above described apparatus specification information of the cartridge 10, etc., applicable to the label producing apparatus 100 from the stored contents of the EEPROM 47, etc., and each of the Web sites WA to WC, as previously described, in the newly provided step S29 and step S291. In the example shown, the apparatus specification information is acquired from the EEPROM 47 in step S29, and all model information is acquired from each of the Web sites WA to WC in step S291.

Subsequently, in step S292, the CPU 44 adds the all model information acquired in the above described step S291 and the apparatus specification information acquired in the above described step S29 to the purchase support information generated in step S26 and step S28. Subsequently, the flow proceeds to step S30. The process of steps S30 and thereafter is the same as that in the above described embodiment, and description thereof will be omitted.

As described above, in this modification, the operator can clearly visually verify not only the model of the cartridge 10, etc., that ceased to exist and that the operator had intended to purchase, and the model of the new cartridge 10, etc., corresponding to that format, but also all other models of the cartridge 10, etc., applicable performance-wise to the label producing apparatus 100 by the print formed on the support information label LA. As a result, the operator can recognize that the cartridges 10, etc., other than the model he or she had presumed are also available for use. Accordingly, it is possible to increase the applicability and extensibility achieved when the operator uses the cartridge 10, etc., to produce labels with the label producing apparatus 100.

Further, in this modification, in addition to the model of the cartridge 10, etc., that the operator intended to purchase, the model of the new cartridge 10, etc., corresponding to that format, and the cartridge model information that indicates the models, etc., of the cartridge 10, etc., that had been used in the label producing apparatus 100 in the past, the operator can clearly visually verify the apparatus specification information, such as the performance information, specification information, and the like, of the label producing apparatus 100 by the print formed on the support information label LA. As a result, user-friendliness can be further improved.

(2) When the Purchase Support Information is Two-Dimensionally Barcode

Figure 6D:
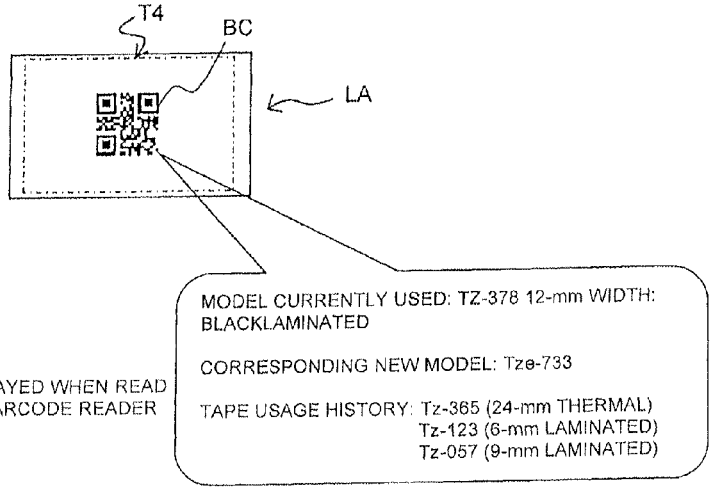
FIG. 6D is a top view showing another example of the outer appearance of a regular printed label produced by the label producing apparatus in an embodiment of the present disclosure, and a top view showing the outer appearance of a printed label on which purchase support information is formed into print in an embodiment of the present disclosure.

FIG. 6D shows an example of the support information label LA of this modification. This support information label LA comprises a two-dimensional barcode area T4 where a two-dimensional barcode BC is formed into print in place of the above described current model and latest model information printing area T1, the usage history information printing area T2, and the printing area T3 for all model information, etc. This two-dimensional barcode BC barcodes the same contents as each set of support information formed into print in the current model and latest model information printing area T1, the usage history information printing area T2, and the printing area T3 for all model information, etc., previously described. That is, according to the support information label LA shown in this FIG. 6D, the two-dimensional barcode BC of the two-dimensional barcode area T4 can be read by a suitable optical reading device (a so-called barcode reader, etc.; not shown) to display the same current model information, latest model information, and all model information of the cartridge 10, etc., as well as the same usage history information, specification information, etc., of the label producing apparatus 100 as the contents formed into print in the above described current model and latest model information printing area T1, the usage history information printing area T2, and the printing area T3 for all model information, etc., on a suitable display portion (not shown).

In the example shown, the same contents as the support information label LA shown in FIG. 6B, that is that the current model of the cartridge 10 is "TZ-378," the width of the color film 11 and the base tape 16 is 12 mm, the color of the base tape 16 is black, the cartridge is the above described cartridge 10 of the laminated type, the corresponding latest model is "Tze-733," the usage history of the label producing apparatus 100 includes "Tz-356" (the thermal-type cartridge 10' having the thermal tape 16' with a 24-mm width), "Tz-123" (the laminated-type cartridge 10 having the cover film 11 with a 6-mm width), and "Tz-057" (the laminated-type cartridge 10 having the cover film 11 with a 9-mm width), are displayed on the above described display portion by the reading of the above described optical reading device.

Figure 10:
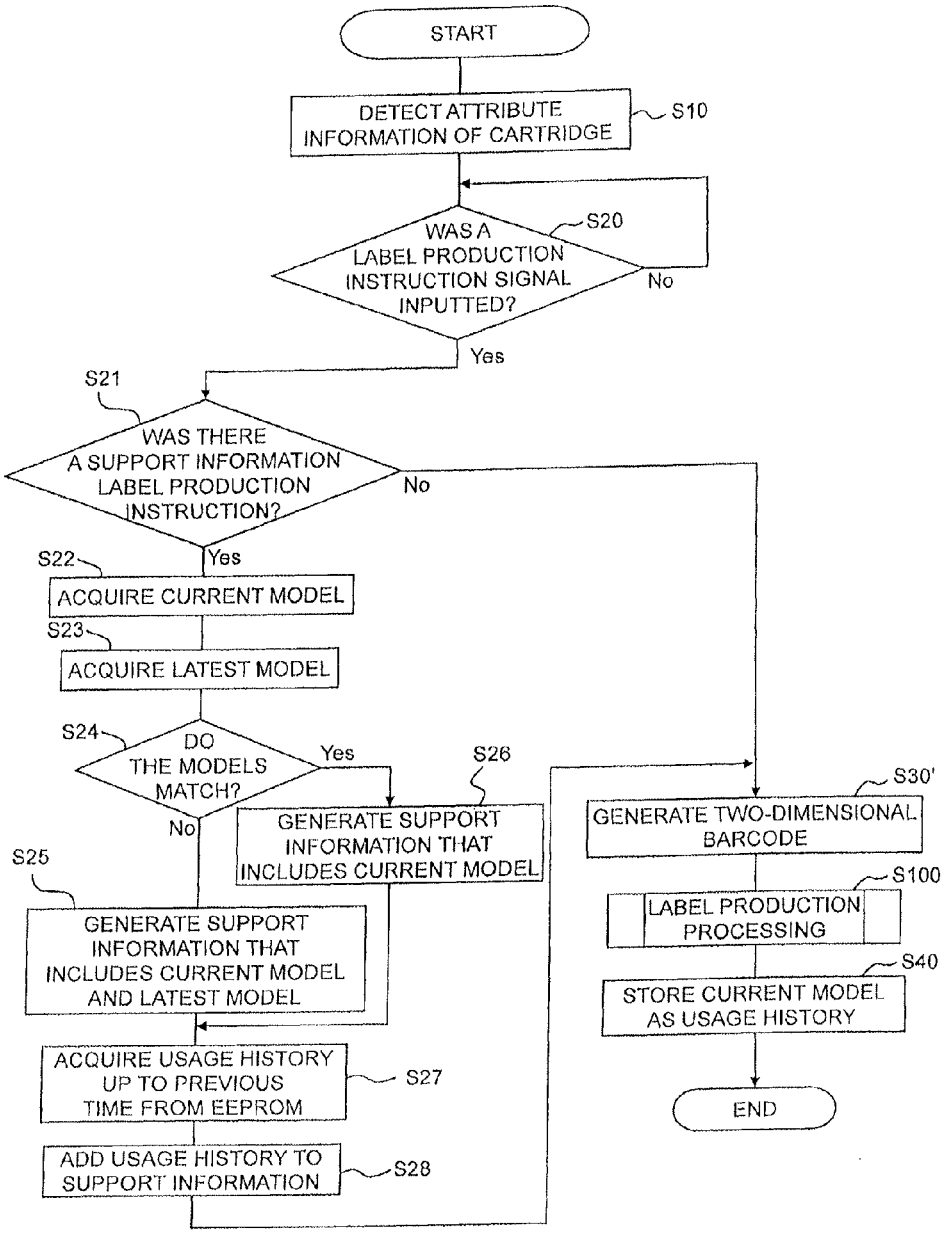
FIG. 10 is a flowchart showing the control contents executed by the CPU in a modification where a two-dimensional barcode with recorded purchase support information is formed into print.

FIG. 10 shows the control contents executed by the CPU 44 in this modification. Note that, in the flow shown in FIG. 10, the only difference from that shown in FIG. 7 is that step S30' is newly provided in place of step S30 shown in FIG. 7.

That is, after step S28 is performed or the decision is made that the condition of step S21 is not satisfied (S21: No), the flow proceeds to step S30'. In step S30', the CPU 44 applies known barcode production technology to and converts the above described print data stored in the text memory 48A in order to produce the printed label L, or the purchase support information generated in the above described steps S25, S26, and S28 in order to produce the support information label LA, and generates a two-dimensional barcode BC such as one that indicates the print data or purchase support information when read by the above described optical reading device. Then, the print data is stored in the print buffer 48B. Note that, in a case where a support information label LA is not produced, that is, in a case where the regular label L is produced, the aforementioned step S30 may be executed rather than this step S30', thereby generating dot pattern data (print-head driving data) corresponding to the regular text previously described. Step S100 and step S40 following step S30' are the same as those in the above described embodiment, and descriptions thereof are omitted.

According to this modification, the two-dimensional barcode BC formed on the support information label LA can be read by an optical reading device to acquire the same model information of the tape cartridge, performance and specification information of the label producing apparatus 100, and the like as the contents formed into print in the above described embodiment and modification (1). As a result, user-friendliness can be further improved. In particular, this modification is advantageous in a case where the amount of purchase support information is excessive and the information cannot be formed into print in its entirety on the support information label LA.

(3) Other

While the above has been described in connection with an illustrative scenario in which the printed label tape 23 with print is cut by the cutter 28 to produce the printed label L or the support information label LA, the present disclosure is not limited thereto. That is, in a case where a label mount (a so-called die cut label) separated in advance to a predetermined size corresponding to the label is continuously disposed on the tape fed out from the roll, the present disclosure may also be applied to a case where the label is not cut by the cutter 28 but rather the label mount (a label mount on which corresponding printing has been performed) only is peeled from the tape after the tape has been discharged from the tape discharging exit 104 to produce the printed label L or the support information label LA.

Note that while the above has been described in connection with an illustrative scenario in which the label producing apparatus 100 directly accesses each of the Web sites WA to WC to acquire various information, such as the latest model information, etc., the present disclosure is not limited thereto. That is, a suitable communication terminal or other communicating apparatus connected to the label producing apparatus 100 may suitably access each of the Web sites WA to WC to continually update and acquire the latest information, and the label producing apparatus 100 may access the communication terminal or communicating apparatus to acquire the above described various information, such as the latest model information, etc. In each of these cases as well, the same advantages are achieved.

Figure 5:
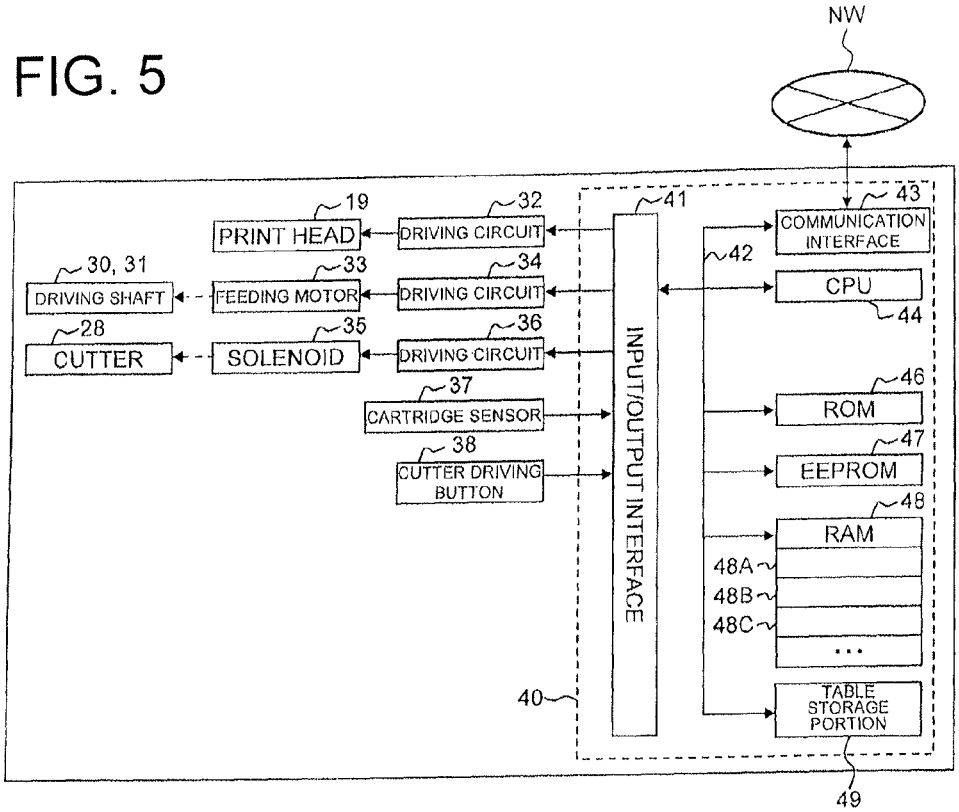
FIG. 5 is a functional block diagram showing the functional configuration of the label producing apparatus.

Note that, in the above, the arrow shown in the FIG. 5 denotes an example of signal flow, but the signal flow direction is not limited thereto. Also note that the present disclosure is not limited to the procedure illustrated in the above described flowcharts of FIG. 7, FIG. 8, FIG. 9, FIG. 10, etc., and additions and deletions as well as sequence changes to the procedure may be made without deviating from the spirit and scope of the disclosure.

Further, other than that already stated above, techniques based on the above described embodiments and each of the modifications may be suitably utilized in combination as well.

What is claimed is:

1. A tape printer comprising:

a cartridge holder configured to mount a tape cartridge configured to supply a print-receiving tape;

a cartridge sensor configured to detect a portion to be detected, the portion formed on said tape cartridge;

a feeding device configured to feed the print-receiving tape supplied from said tape cartridge mounted to said cartridge holder;

a printing device configured to perform desired printing on said print-receiving tape fed by said feeding device, a communication device configured to perform network communication with a communication line; and a controller configured to:

detect attribute information of said tape cartridge mounted to said cartridge holder via said cartridge sensor;

identify a model of the mounted tape cartridge in accordance with the detected attribute information, and acquire corresponding current model information;

acquire latest model information of said tape cartridge corresponding to the detected attribute information via said communication device, from an information providing device related to said tape cartridge;

generate purchase support information based on the acquired current model information and the acquired latest model information, when the tape cartridge of a model indicated by said current model information or said latest model information is to be newly purchased; and control said printing device so that the generated purchase support information is formed into print on said print-receiving tape, wherein said controller is configured to further determine whether or not the acquired latest model information and the acquired current model information match with each other, wherein:

in a case where it is determined that said latest model information and said current model information match with each other, said controller generates said purchase support information that includes said current model information, and controls said printing device so that said purchase support information that includes said current model information is formed into print on said printer-receiving tape; and in a case where it is determined that said latest model information and said current model information do not match with each other, said controller generates said purchase support information that includes both said latest model information and said current model information, and controls said printing device so that said purchase support information that includes both said latest model information and said current model information is formed into print on said print-receiving tape.

2. The tape printer according to claim 1, wherein:

said controller is configured to further acquire all model information of said tape cartridge applicable to said tape printer or information corresponding thereto via said communication device, wherein:

said controller is configured to generate said purchase support information that includes at least a portion of the acquired all model information or information corresponding thereto.

3. The tape printer according to claim 1, wherein:

said controller is configured to detect said attribute information via said cartridge sensor, the attribute information including at least one of a tape width, tape color, and tape material of said print-receiving tape stored within said tape cartridge.

4. The tape printer according to claim 1, wherein:

said controller is configured to generate said purchase support information that includes performance information or specification information of said tape printer.

5. The tape printer according to claim 1, wherein:

said controller is configured to further convert the generated purchase support information into two-dimensional barcode information and generating two-dimensional barcode information capable of displaying said the purchase support information when read by an optical reading device, and said controller is configured to control said printing device so that the generated two-dimensional barcode information is formed into print on said print-receiving tape.

6. A tape printer comprising:

a cartridge holder configured to mount a tape cartridge configured to supply a print-receiving tape;

a cartridge sensor configured to detect a portion to be detected, the portion formed on said tape cartridge;

a feeding device configured to feed a print-receiving tape supplied form said tape cartridge mounted to said cartridge holder;

a printing device configured to perform desired printing on said print-receiving tape fed by said feeding device, a communication device configured to perform network communication with a communication line;

a controller configured to:

detect attribute information of said tape cartridge mounted to said cartridge holder via said cartridge sensor;

identify a model of the mounted tape cartridge in accordance with the detected attribute information, and acquire corresponding current model information;

acquire latest model information of said tape cartridge corresponding to the detected attribute information via said communication device, from an information prociding device related to said tape cartridge;

generate purchase support information based on the acquired current model information and the acquired latest model information, when the tape cartridge of a model indicated by said current model information of said latest model information is to be newly purchased;

control said printing device so that the generated purchase support information is formed into print on said print-receiving tape; and a history storage device configured to store a plurality of sets of said current model information respectively acquired as usage history information based on attribute information respectively detected via said cartridge sensor, the plurality of sets of the current model information being pertaining to the plurality of models of said tape cartridge, when said plurality of models of said tape cartridge are sequentially mounted to said cartridge holder and used while being replaced, wherein:

said controller is configured to generate said purchase support information that includes at least a portion of said usage history information stored by said history storage device.

7. The tape printer according to claim 6, wherein:

said controller is configured to further acquire all model information of said tape cartridge applicable to said tape printer or information corresponding thereto via said communication device, wherein:

said controller is configured to generate said purchase support information that includes at least a portion of the acquired all model information or information corresponding thereto.

8. The tape printer according to claim 6, wherein:

said controller is configured to detect said attribute information via said cartridge sensor, the attribute information including at least one of a tape width, tape color, and tape material of said printer-receiving tape stored within said tape cartridge.

9. The tape printer according to claim 6, wherein:

said controller is configured to generate said purchase support information that includes performance information or specification information of said tape printer.

10. The tape printer according to claim 6, wherein:

said controller is configured to further convert the generated purchase support information into two-dimensional barcode information and generating two-dimensional barcode information capable of displaying said the purchase support information when read by an optical reading device, and said controller is configured to control said printing device so that the generated two-dimensional barcode information is formed into print on said print-receiving tape.

* * * * *